United States Patent [19]

Bell et al.

[11] 4,276,042

[45] Jun. 30, 1981

[54] STITCHING MACHINE FOR PREFORMED CONTAINERS

[75] Inventors: John T. Bell, St. Charles; Max E. Bender, Glen Ellyn, both of Ill.

[73] Assignee: Container Corporation of America, Chicago, Ill.

[21] Appl. No.: 83,561

[22] Filed: Oct. 11, 1979

[51] Int. Cl.[3] ..... B31B 1/68

[52] U.S. Cl. ..... 493/118; 493/119; 493/384

[58] Field of Search ..... 93/55.1 M, 41.1, 39 R, 93/55, 55.1 P, 55.1 R, 39.1 P, 39.1 R; 53/138; 227/106, 99, 104, 103, 100; 493/118, 119, 384, 385, 394

[56] References Cited

U.S. PATENT DOCUMENTS

| | | | |
|---|---|---|---|
| 877,891 | 1/1908 | Horton | 93/41.1 |
| 1,430,150 | 9/1922 | Bliss | 227/99 |
| 1,859,640 | 5/1932 | Walter | 93/39 R X |
| 2,486,893 | 11/1949 | Van Doren | 227/103 X |

*Primary Examiner*—James F. Coan

*Attorney, Agent, or Firm*—Davis Chin; Richard W. Carpenter

[57] ABSTRACT

The end wall of a Bliss-type container is secured to the flanges extending from the side walls and the bottom of the container, the securing being accomplished by a single stitching device. The container body is caused to move in a closed path on a carriage or platen for the stitching operation.

The term "stitching" herein is not intended to merely mean the use of staples, but is intended to mean, for example, the use of an eyelet machine, a riveting machine, or a commercial sewing machine.

7 Claims, 15 Drawing Figures

STITCHING MACHINE FOR PREFORMED CONTAINERS

BACKGROUND OF THE INVENTION

1. Field of the Invention

This invention relates to stitching machines and, more particularly, to stitching machines for preformed containers.

2. The Prior Art

Bliss-type containers are well known in the art. Heretofore such containers have been made by an array of stitching devices, two arrays stitching the side flanges to the end wall, and a third array stitching the bottom flanges to the end wall. Such practice has required movement of the arrays for their operation, the container remaining in a fixed position for the stitching operation. The prior art appears to be best exemplified in the following U.S. Pat. Nos.

Paxton—3,590,700
Striplin—3,673,928
Bell et all—3,456,652
Bliss—1,430,150

None of said patents teaches the use of a single stitching head nor the movement of a container body as taught in the present application.

SUMMARY OF THE INVENTION

The operations entailed in the making of a Bliss type container includes at least one stitching head, the container body moving in a closed path to preselected positions where the flanges are secured to the end walls in a predetermined sequence. While the structure hereof is presented in the environment of stitching or stapling devices, it is within the scope of this invention to include the eyelet making devices and the commercial sewing machines as well.

THE DRAWINGS

GENERAL DESCRIPTION OF THE STRUCTURE

Figure 1:
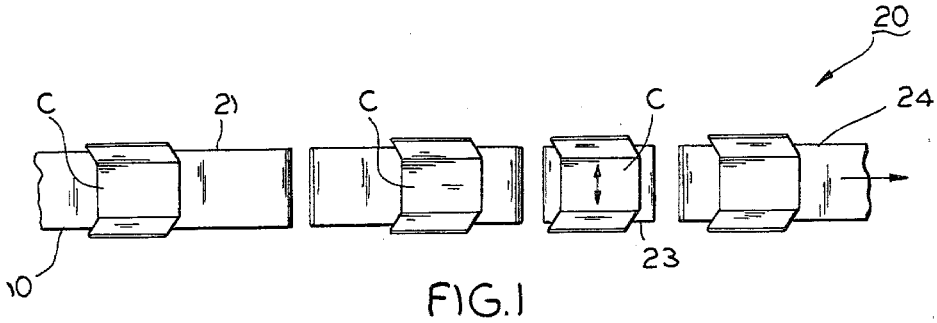
FIG. 1 is a schematic plan view of the apparatus according to the present invention.
Figure 2:
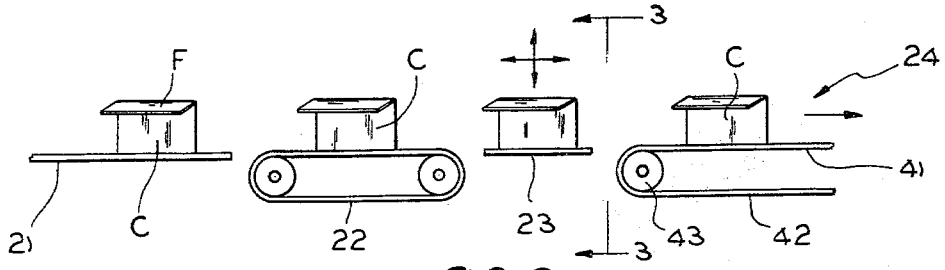
FIG. 2 is an elevational view thereof.
Figure 3:
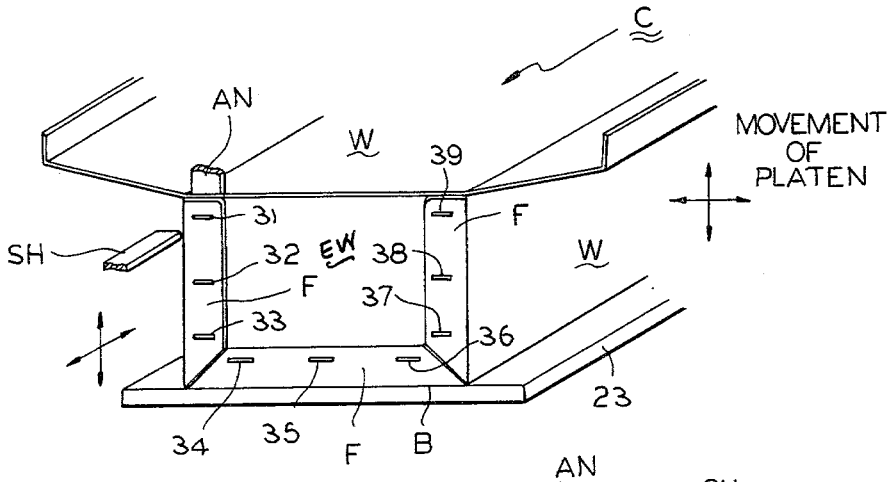
FIG. 3 is an isometric view of one end of a container which has been stitched by the apparatus of the present invention, said view looking in the direction of the arrows 3—3 of FIG. 2.

In its general aspects the invention structure is denoted by the reference numeral 20 and includes a feed conveyor 21 transporting container bodies C having opposed walls W and a bottom wall B, all foldably interconnected, an end wall EW being secured to flanges F extending from walls W and bottom wall B. The end wall EW is held to the flanges F in a gluing operation by equipment not related to this invention.

The container body C moves on the feed conveyor 21 to an intermittent conveyor 22 arranged to move a single container body C in proper timed relationship to a carriage or platen 23 moving in a closed orbital path and cooperating with a stitching head SH and an anvil AN to secure the end wall EW to the body C. The stitching head SH is arranged to place an array of stitches through the flanges F and the end wall EW, and in so doing an anvil AN is situated within the container body C.

It should be noted at this point that the stitching head SH and the anvil AN do not move, but that the container body C moves with the carriage or platen 23 in a closed path, the stitching head SH and the anvil AN cooperating to make a first array of stitches 31, 32, 33 on the container body C as the platen 23 moves upward. A second array 34, 35, 36 is made as the platen 23 moves laterally, and a third array 37, 38 and 39 as the platen 23 moves downward. It should be noted that the platen 23 has a movement made up of both horizontal and vertical components as the container body C moves therewith between the stitches 33 and 34, the same movement (but in a opposite sense) taking place between the stitches 36 and 37.

After completion of a sequence of stitching on the container, the same moves to a delivery conveyor 24 having a conveying reach 41 and a return reach 42.

Figure 6:
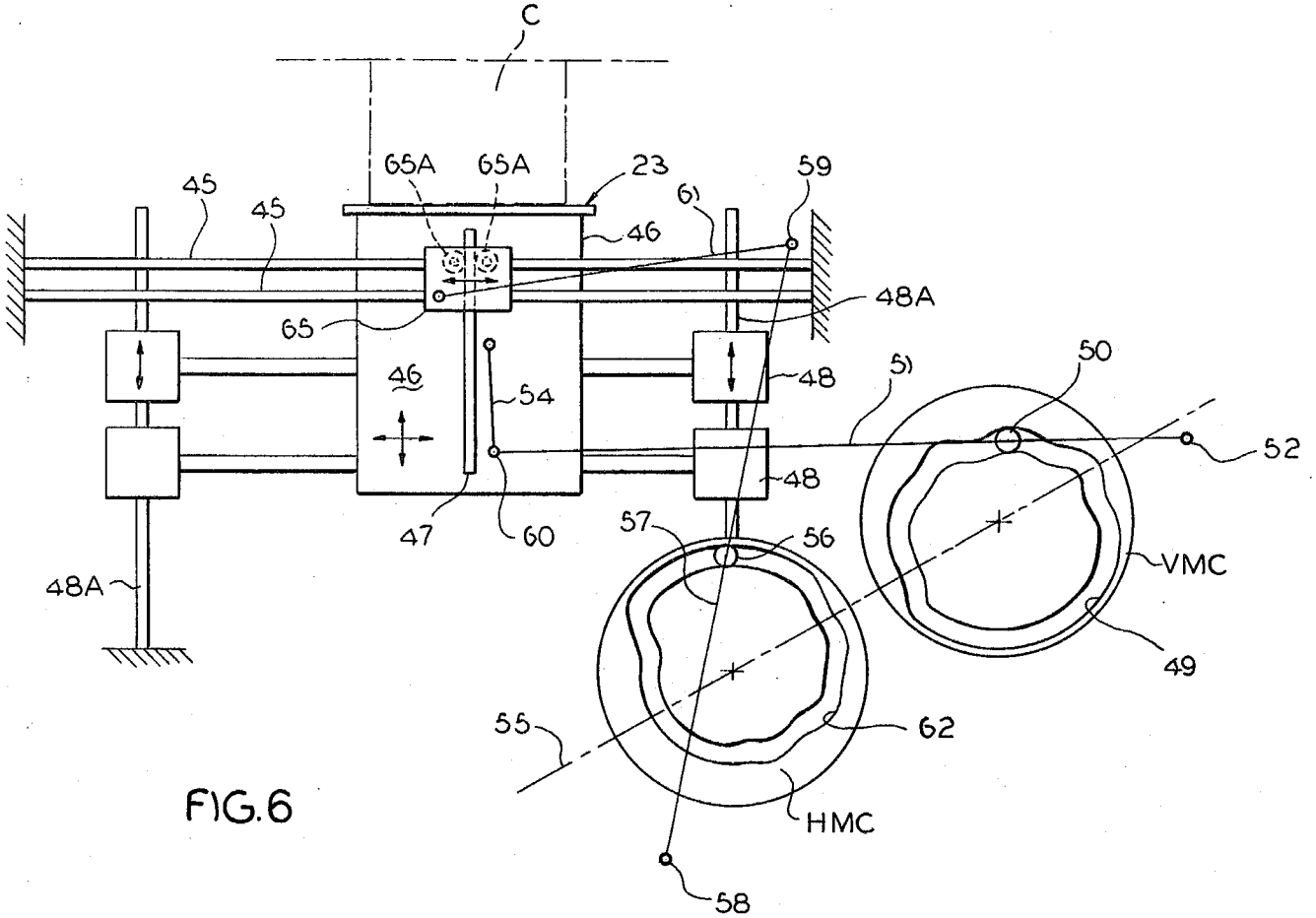
FIG. 6 is a schematic view of certain apparatus for stitching the container of FIG. 3.
Figure 10:
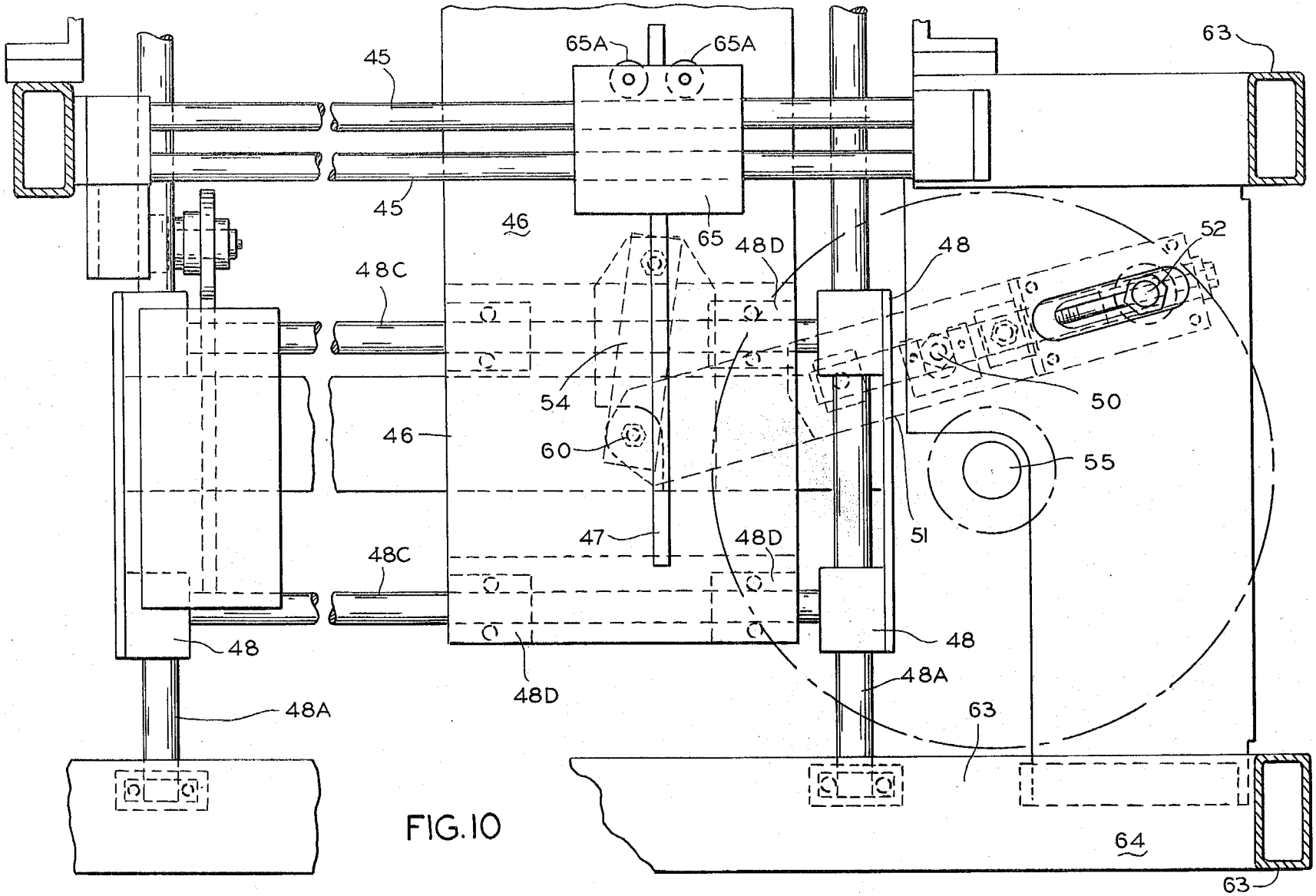
FIG. 10 is an elevational view of the structure for causing vertical movement of a platen for supporting a container for stitching thereon.
Figure 11:
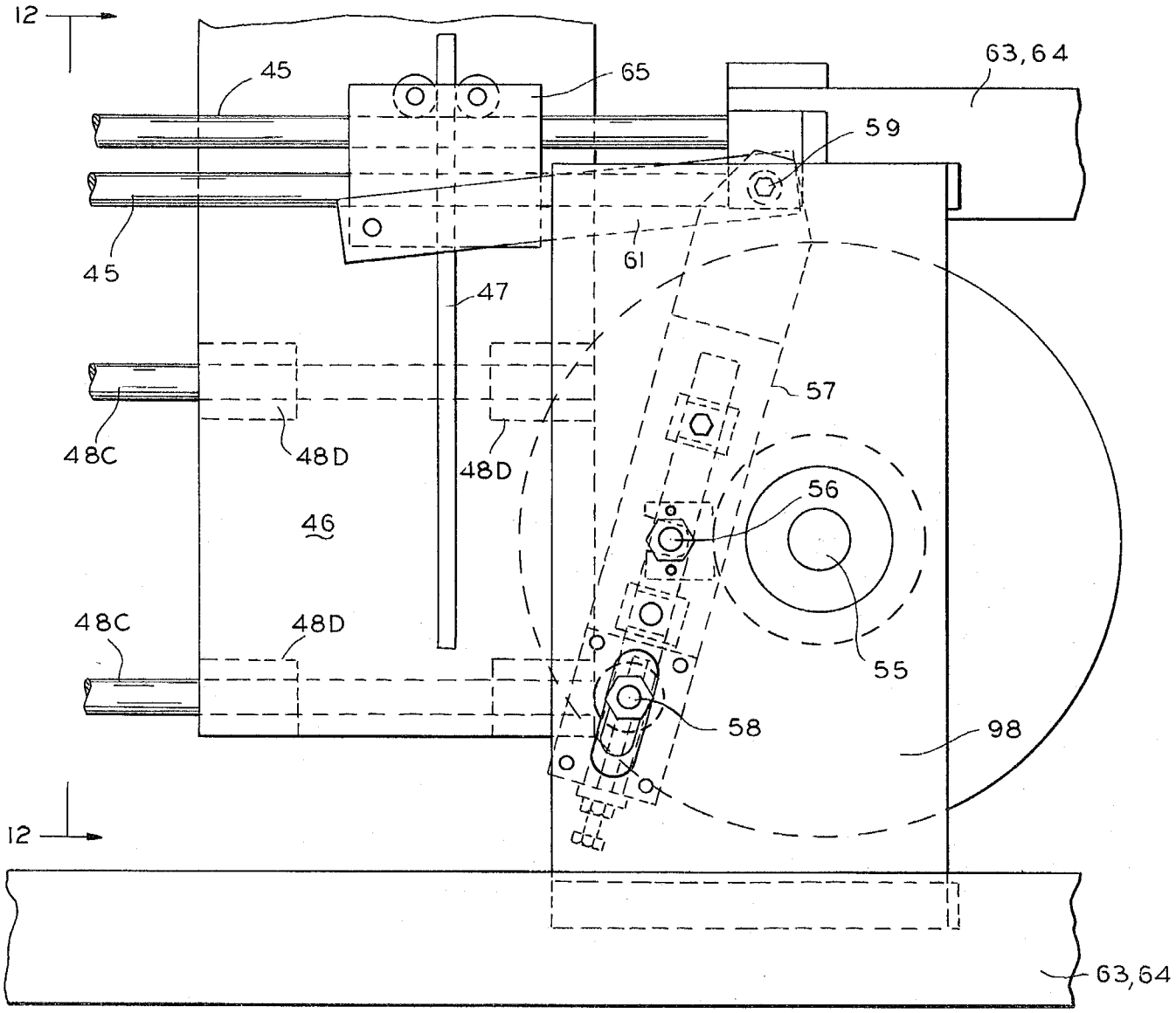
FIG. 11 is an elevational view of the structure for imparting horizontal movement to the platen.
Figure 12:
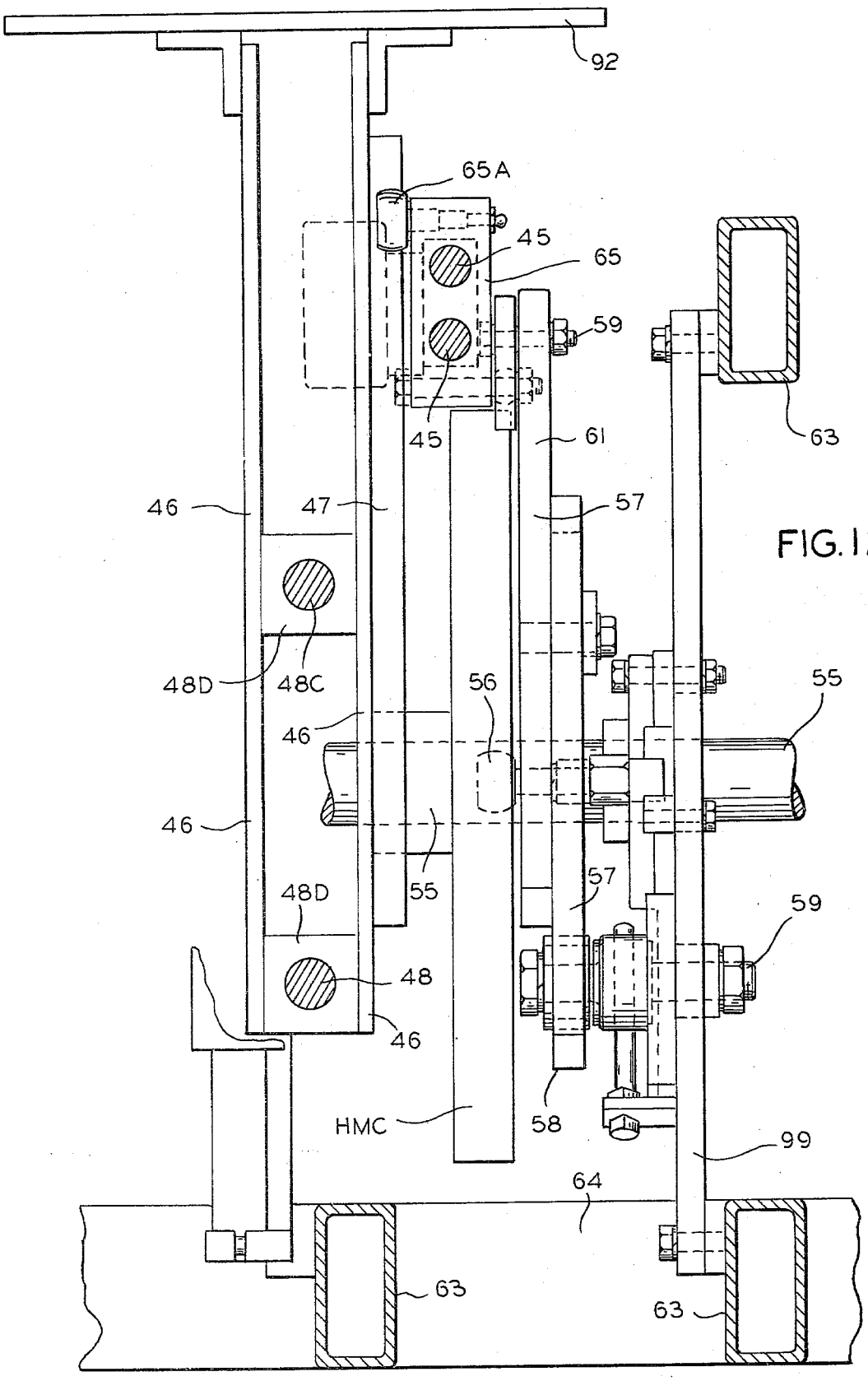
FIG. 12 is an end elevational view of FIG. 11 looking in the direction of the arrows 12—12 thereof.

Referring now to FIG. 6 (see also FIG. 12), the platen 23 is supported on a pair of depending frame members 46, guided for vertical movement on spaced vertical guide rails 48A (see also FIG. 10) and on slide blocks 48 having horizontal guide rails 48C therebetween. The frame members 46 have slide blocks 48D therebetween enabling the members 46 to move in a horizontal direction on the rails 48C.

The platen 23 is mounted atop the spaced frame members 46, and the latter is supported for horizontal movement upon the horizontal rails 45.

Vertical movement is given to the platen 23 by a vertical motion cam VMC having a cam profile 49 in a face thereof. Cam VMC cooperates with a cam follower 50 mounted on a follower arm 51 having an adjustable pivot point 52 at one end thereof. The follower arm 51 has its opposite end pivotally connected at 60 to a link 54 pivotally connected to a slide 47 extending from one of the frame members 46.

Horizontal movement is given to the platen 23 by a horizontal motion cam HMC fastened upon a shaft 55. The cam HMC has a profile 62 in a face thereof which cooperates with a follower 56 on a follower arm 57 having an adjustable pivoted abutment 58 at one end thereof and a pivoted connection 59 to a link 61 connected to a carriage 65 sliding on the rails 45. The carriage 65 has spaced rollers 65A engaging the slide 47, so that the frame members 46 can have the necessary vertical movement at the same time.

It should be noted at this point that the cam profiles 49 and 62 are shown schematically only. Adjustment of the abutments 52 and 58 for the respective follower arms 51 and 57 is not shown in FIG. 6, but adjustment is made according to the size of the container body C on the platen 23, as will be seen more clearly in FIG. 13.

By reason of the adjustment of the abutments for the follower arms 51 and 57, the vertical and horizontal movement of the platen 23 can be varied, so that the machine can be readily adjusted to handle a run of containers of different sizes. By suitably calibrating the location of such abutments and readily changing the position according to such calibrations, a ready change can be made for a run of different size containers. The design of the cam can be changed to provide a variety of desirable stitch patterns and configurations.

DETAILED DESCRIPTION OF THE INVENTION STRUCTURE

1. Description of Intermittent Conveyor

Figure 7:
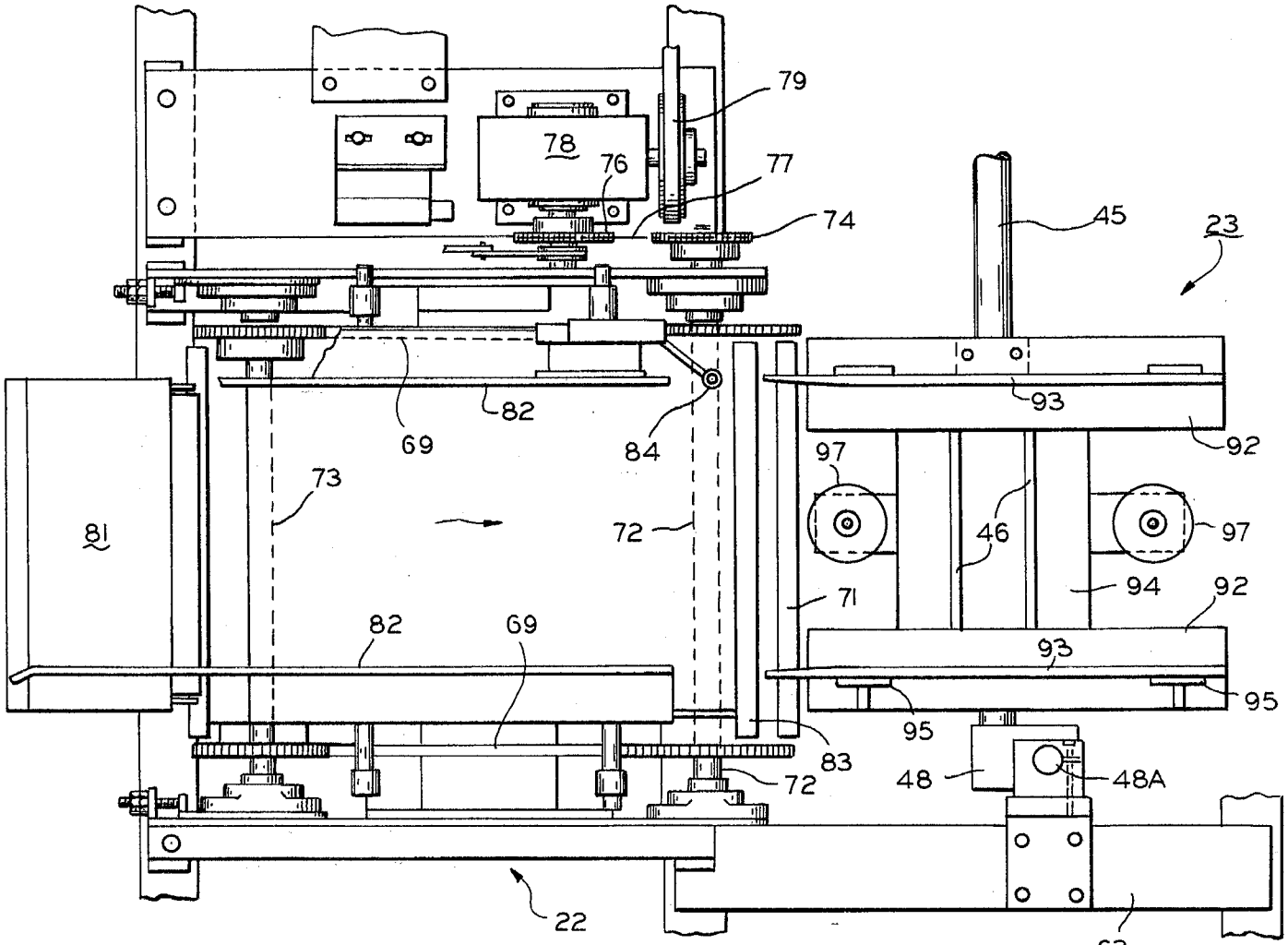
FIG. 7 is a plan view of details of the apparatus of this invention.
Figure 8:
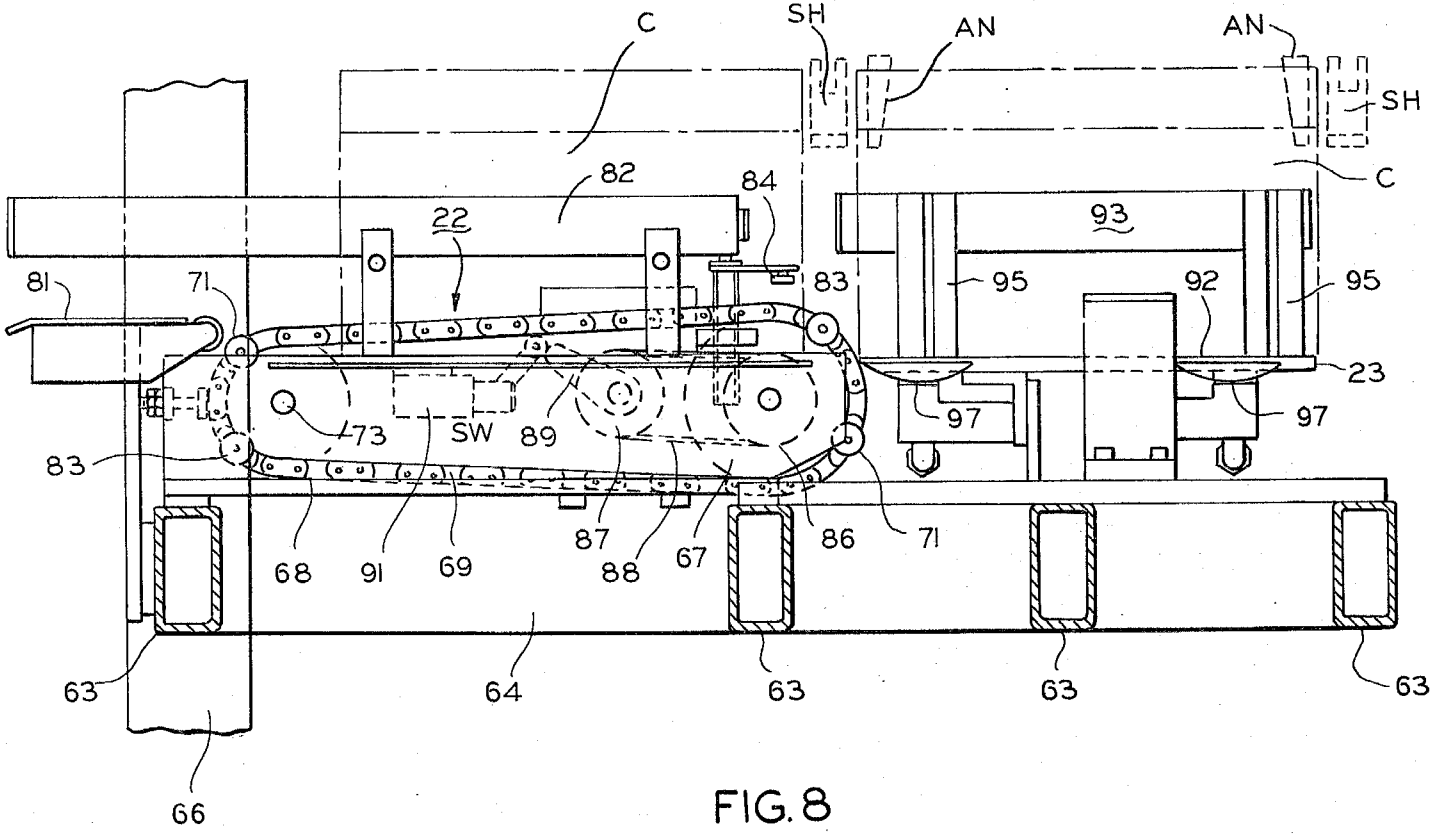
FIG. 8 is an elevational view thereof.

The intermittent conveyor 22 receiving a container body C from the feed conveyor 21 is arranged to move in an intermittent fashion to place the body C on the platen 23 for a series of operations thereon, and to move same on to the delivery or takeaway conveyor 24. The conveyor 22 is best seen with particular reference to FIGS. 7 and 8, and is supported on a framework consisting of intersecting horizontal members 63 and 64 supported on the vertical frame members 66.

The conveyor 22 has spaced sprockets 67 and 68 having sprocket chains 69 reeved therebetween, chains 69 supporting the transversely extending flight bars 71.

The sprockets 67 are positioned on a shaft 72 driven by sprockets 74 and 76, a chain 77, a speed reducer train 78 and a drive belt 79 connected to a drive motor, not seen. An electric clutch-brake, not seen, is interposed between the motor and the reducer train 78 for a purpose as will appear.

The container bodies C from the feed conveyor 21 move across a feed shelf 81 on to the flights 71 and between the vertical and laterally spaced guides 82. Feeding by the conveyor 21 moves container body C to a stop bar 83 and against a start switch 84 for the motor and electric clutch-brake, driving the speed reducer 78 to drive the intermittent conveyor 22.

The conveyor 22 is designed to move two container bodies C for each full traverse of the flights 71, and is designed to cease operation after the transfer of a container body C to the platen 23, which then moves through a complete stitching cycle. Accordingly, the shaft 72 has a sprocket 86 fastened thereon, its pitch diameter being one-half the pitch diameter of the sprocket 67. The sprocket 86 turns a sprocket 87 by a sprocket chain 88 in a 1:1 ration, the sprocket 87 carrying an actuator 89 for a switch 91 which opens to stop the motor and clutch-brake speed reducer 78.

Figure 4:
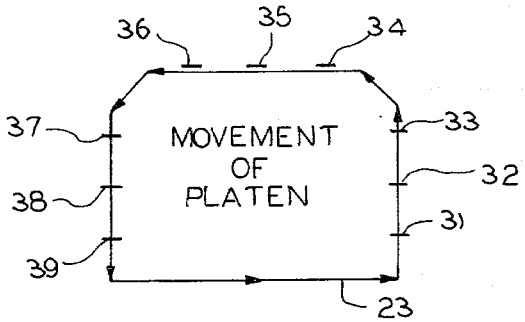
FIG. 4 is a schematic view showing the orbital path taken in completing the stitching of the container seen in FIG. 3.
Figure 5:
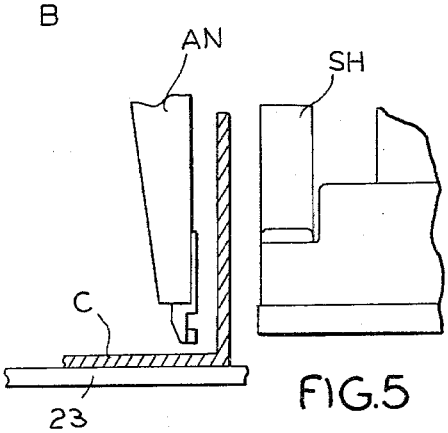
FIG. 5 is a schematic view of a stitching device employed in completing the container of FIG. 3.

The opening of a switch 91 starts the cycling of the platen 23 which goes through the movements, seen in FIG. 4, during which the shaft 55 supporting cams VMC and HMC make one complete revolution. When the platen 23 completes its cycle, and a successive container C is moved on the conveyor 22 by pushing of successive containers, the switch 84 is again closed to start the conveyor 22 to deliver a container C to the platen 23 while the movement of the conveyor 22 continues until it is stopped by opening of the switch 91.

The circuit interlocking switches 84 and 91, the speed reducer 78 and the shaft 55 are not shown, as they are elements believed to be within the ordinary skill of one in the art.

DESCRIPTION OF THE PLATEN AND THE CYCLE OF MOVEMENT

Referring now to FIGS. 7 to 11 inclusive, when the intermittent conveyor 22 has delivered a container body C to the platen 23, such delivery causes a completely stitched container C positioned on the platen 23 to be moved therefrom to the delivery conveyor 24.

The platen 23 includes laterally spaced support plates 92 for the container body C, it being guided between vertical guides 93 extending upward from the plates 92 which are supported on standards 95 extending upward from the support plates 92. Cross members 94, in the form of angles, maintain the plates 92 in spaced-apart relationship and are secured to the underside of the plates 92. The cross members 94 are connected to the frame members 46. The platen 23, together with the cross member 94 and the frame members 46, is enabled to have lateral movement in a direction normal to the direction of flow of the containers C on the conveyors 21 and 22, as well as a vertical movement to complete a stitching cycle, as seen in FIG. 4.

The container body C on the platen 23 is maintained in position by vacuum cups 97 which engage a bottom B of the body C. The vacuum is effective to prevent dislodging of the body C as it moves past an anvil AN and a stitcher head SH.

Figure 9:
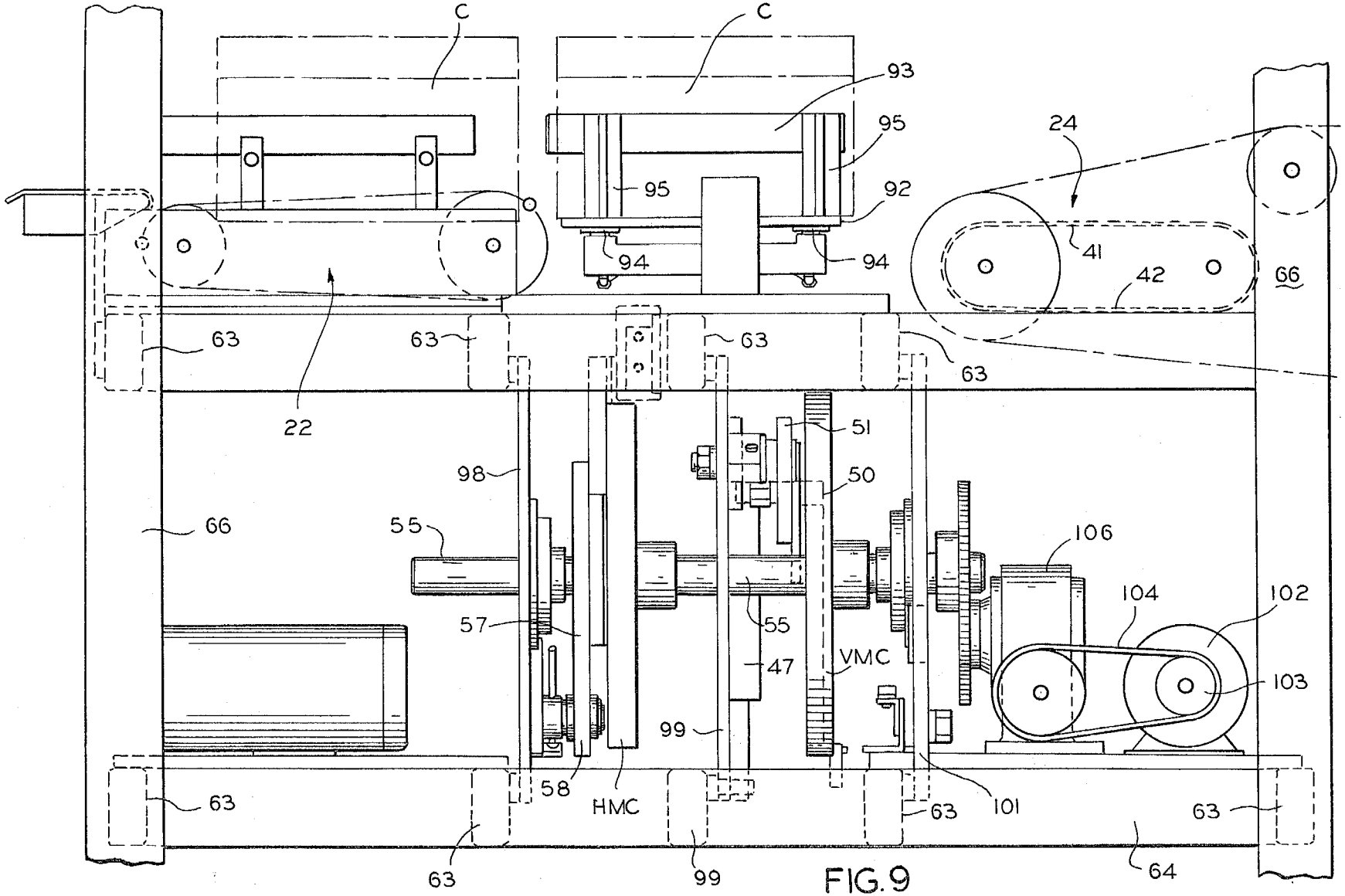
FIG. 9 is an elevational view of further details of the apparatus seen in FIGS. 7 and 8, and showing details of a delivery conveyor for a finished container body.

The platen 23, with the container body C thereon, is moved through the cycle previously described by the cams VMC and HMC and their respective cam follower arms which are connected in such a fashion as to give both vertical and horizontal movement to the platen 23. The cams HMC and VMC are secured on the common shaft 55 which, in turn, is journaled in spaced vertical support plates 98, 99 and 101 which extend between the upper and lower frame members 63 and 64 and below the intermittent conveyor 22 and the platen 23, as best seen in FIG. 9.

The shaft 55, supporting cams VMC and HMC, is driven by a motor 102 through a clutch-brake 103, drive belt 104 and a speed reducer 106. As was previously described with respect to intermittent conveyor 22, the shaft 55 makes one revolution to initiate and complete a stitching operation, while the operation of the motor 102 and the clutch-brake 103 is in accordance with conditions obtaining at the conveyor 22.

Figure 13:
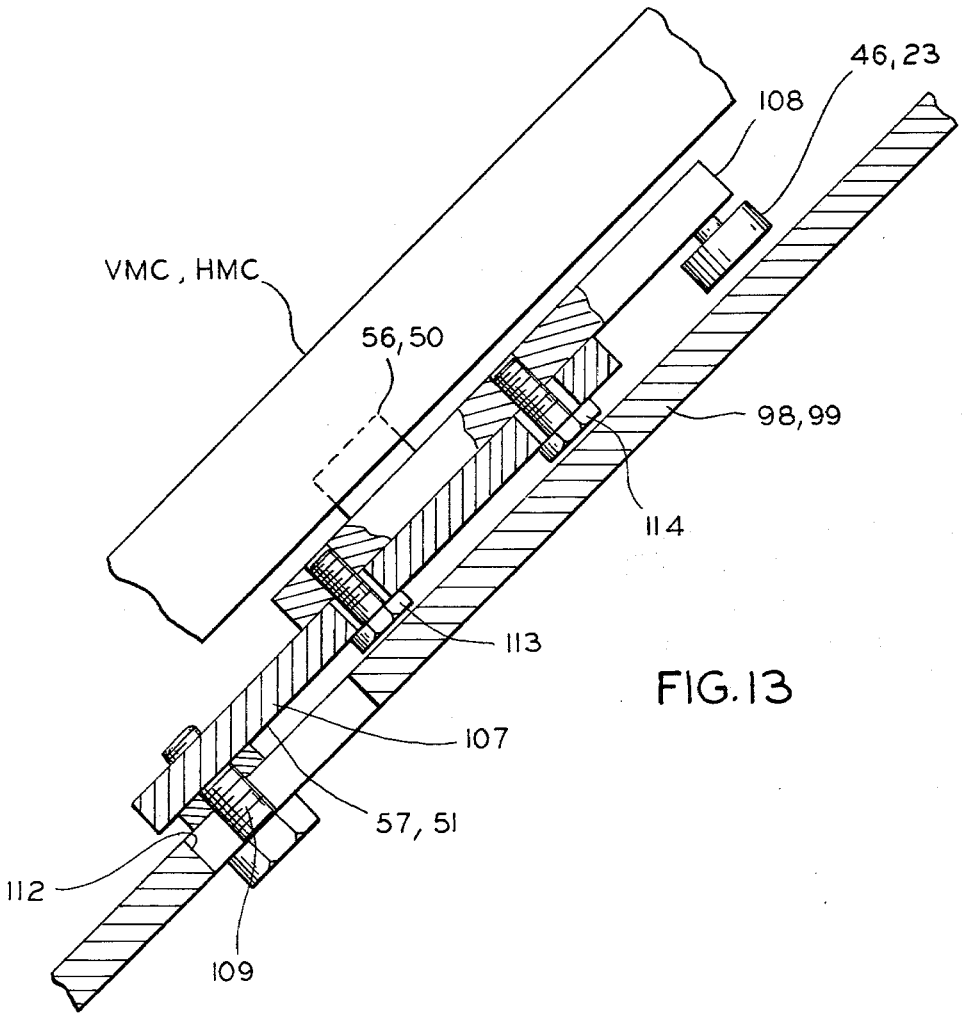
FIG. 13 is a view showing a cam follower adjusting structure.

As best seen in FIG. 13, the vertical and horizontal travel of the platen 23 is adjusted by varying the length of the follower arms 51 and 57 cooperating with their respective motion cams. FIG. 13 is a typical view for each of such follower arms and is composed of two elements 107 and 108. The element 107 has a pivoted connection 109 consisting of through bolt 111 adjustable in position in a slot 112 in the support plates 98 and 99. The follower 50 and 56 is supported on the element 108 which is connected to vertical moving frame members 46 and horizontal-vertical moving platen 23. The two elements 107 and 108 are stitched together by through bolts 113 and 114.

Figure 14:
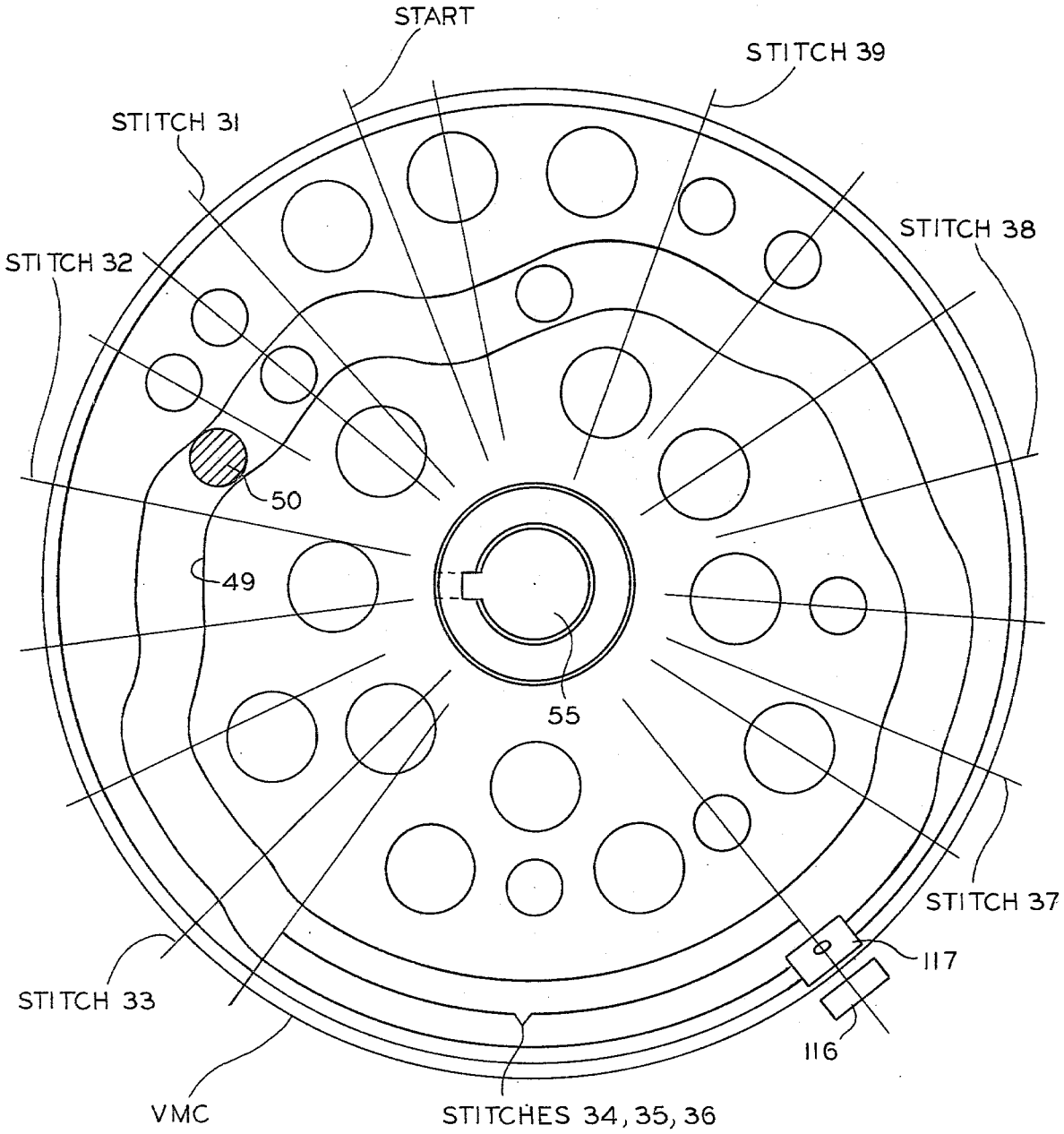
FIG. 14 is a schematic view of a cam for imparting vertical movement to the carriage.
Figure 15:
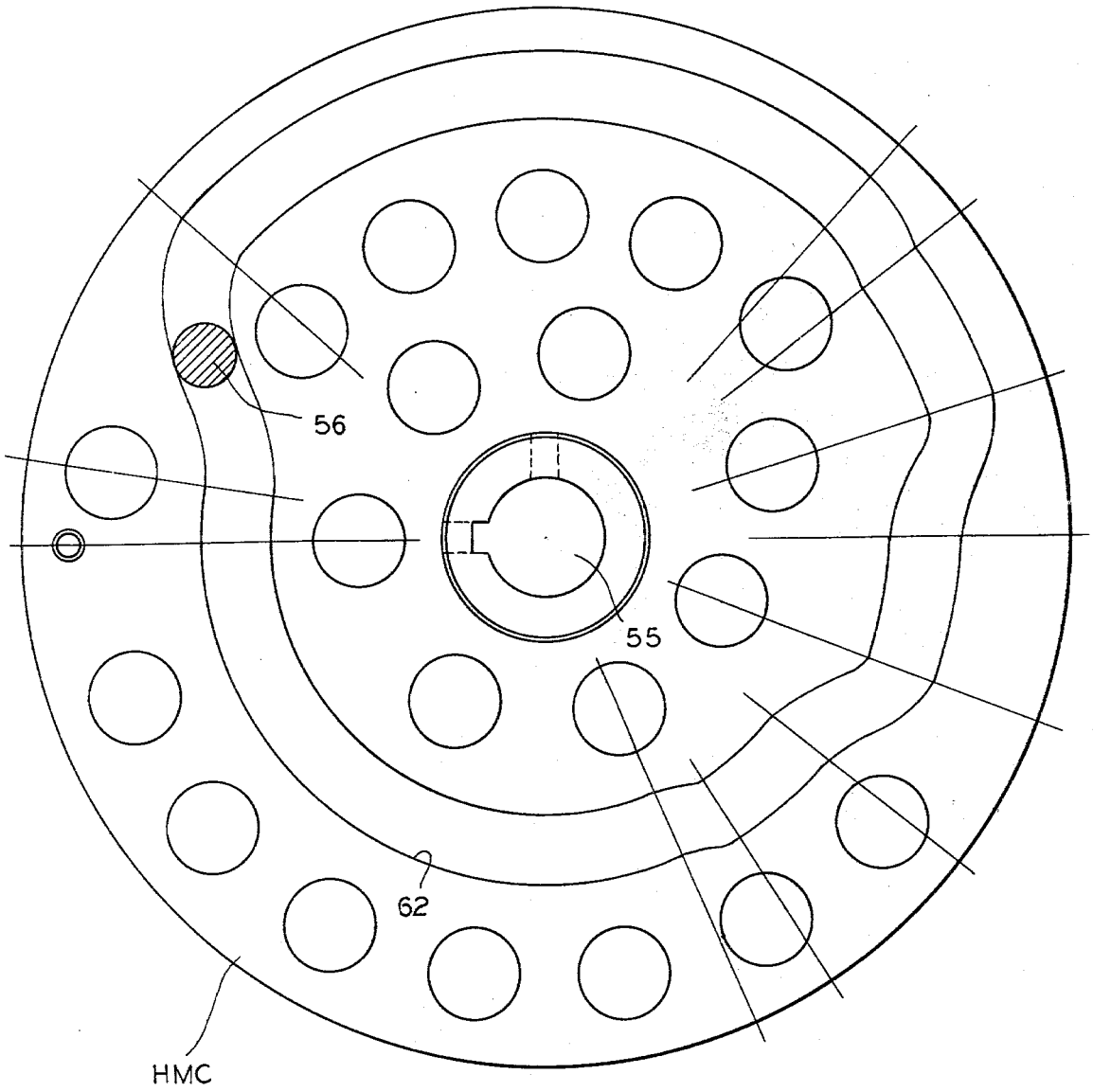
FIG. 15 is a schematic view of a cam for imparting horizontal movement to the carriage.

The displacement of the platen 23 in an horizontal direction is controlled by the cam HMC, and the displacement of the frame members 46 vertically (supporting platen 23) is controlled by cam VMC. The two cams HMC and VMC control the movement of the container body C to provide a closed path of movement thereof. The cam VMC has the additional function of controlling the operation of the stitching means, which, as disclosed herein, comprises the anvil AN and the stitching head SH. Reference is now made to FIG. 14, showing the cam VMC and the switching means controlled by the displacement thereof.

The cam VMC has the profile 49 with the follower 56 in the groove of the profile causing the frame members 46 and the platen 23 to have proper vertical motion for making stitches 31 to 33 and 37 to 39. The cam VMC cooperates with the cam HMC, which latter cam gives lateral movement to the platen 23, so that the stitches 34 to 36 can be made while there is no vertical movement of the platen 23.

The stitching operation by the anvil AN and the stitching head SH is controlled by a proximity switch 116 disposed near the periphery of the cam VMC. It is actuated at specified intervals depending upon the position of displacement of the cam VMC by actuators 117 held to the periphery of the cam VMC in any convenient manner. In FIG. 14 only one of such actuators 117 is shown, but eight additional actuators are spaced at proper intervals along the periphery of the cam VMC, each to cause operation of the stitching device at a proper time.

The cams VMC and HMC can be adapted to be employed for stitching operations of a different number than those shown. Such variations in configuration after learning the teachings herein are believed to be within the scope of one skilled in the art.

We claim:

1. Apparatus for forming a multiple piece container having hingedly connected first, second and third walls with corresponding flanges secured in lapping relationship to a separate end wall by securement in position of fastening means spaced along said flanges and holding said flanges to said end wall, comprising:

(a) a platen for supporting a container body having said end wall in position against said flanges;
(b) means operable upon said fastening means to cause said flanges and said end walls to be secured together;
(c) means for moving said platen in a closed path whereby the flanges of said first, second and third walls are secured to said end wall in the order named;
(d) a frame having vertical movement with said platen being mounted thereon;
(e) means for moving said platen horizontally with respect to said frame;
(f) first cam and follower means for moving said frame in vertical directions;
(g) second cam and follower means for moving said platen horizontally; and
(h) one of said cam and follower means including means for controlling said fastening means.

2. Apparatus according to claim 1, wherein an intermittently operated conveyor advances a container body onto said platen, and wherein said conveyor is inoperable during movement of said platen.

3. Apparatus according to claim 2, wherein the operation of said conveyor in placing a container body on said platen removes a previously completed container body from said platen.

4. Apparatus according to claim 1, wherein said first and second cam means are mounted on a common shaft.

5. Apparatus for forming a multiple piece container having hingedly connected first, second and third walls with corresponding flanges secured in lapping relationship to a separate end wall by securement in position of fastening means spaced along said flanges and holding said flanges to said end wall, comprising:

(a) a platen for supporting a container body having said end wall in position against said flanges;
(b) means operable upon said fastening means to cause said flanges and said end walls to be secured together;
(c) means for moving said platen in a closed path whereby the flanges of said first, second and third walls are secured to said end wall in the order named;
(d) a frame having vertical movement with said platen being mounted thereon;
(e) means for moving said platen horizontally with respect to said frame;
(f) first cam and follower means for moving said frame in vertical directions;
(g) second cam and follower means for moving said platen horizontally; and
(h) each of said follower means being adjustable according to the size of a container body.

6. Apparatus for forming a multiple piece container having hingedly connected first, second and third walls with corresponding flanges secured in lapping relationship to a separate end wall by securement in position of fastening means spaced along said flanges and holding said flanges to said end wall, comprising:

(a) a frame;
(b) a platen supported on said frame and supporting a container body having said end wall in position against said flanges;
(c) means operable upon said fastening means to cause said flanges and said end walls to be secured together;
(d) means for moving said platen in an orbit whereby the flanges of said first, second and third walls are secured to said end wall in the order named;
(e) a second frame having said platen supported thereon and movable vertically with respect to said first named frame;
(f) first cam and follower means for moving said second frame in vertical directions;
(g) second cam and follower means for moving said platen horizontally with respect to said second frame; and
(h) one of said cam and follower means including means for controlling said fastening means.

7. Apparatus according to claim 6, wherein an intermittently operated conveyor advances a container body onto said platen, and wherein said conveyor is inoperable during movement of said platen.

* * * * *